US005572623A

United States Patent [19]

Pastor

[11] Patent Number: 5,572,623

[45] Date of Patent: Nov. 5, 1996

[54] METHOD OF SPEECH DETECTION

[75] Inventor: Dominique Pastor, St Loubes, France

[73] Assignee: Sextant Avionique, Meudon la Foret, France

[21] Appl. No.: 139,740

[22] Filed: Oct. 21, 1993

[30] Foreign Application Priority Data

Oct. 21, 1992 [FR] France ..... 92 12582

[51] Int. Cl.[6] ..... G10L 5/06

[52] U.S. Cl. ..... 395/2.42; 395/2.62; 395/2.57

[58] Field of Search ..... 381/34, 47, 38, 381/43, 46, 122; 367/1; 342/15; 324/76.47, 76.55; 984/260; 395/2.42, 2.17, 2.34, 2.57, 2.62

[56] References Cited

U.S. PATENT DOCUMENTS

| | | | |
|---|---|---|---|
| 4,627,091 | 12/1986 | Fedele | 395/2.42 |
| 4,777,649 | 11/1988 | Carlson | 395/2.42 |
| 4,890,325 | 12/1989 | Taniguchi et al. | 381/34 |
| 4,912,764 | 3/1990 | Hartwell et al. | 381/38 |
| 4,918,735 | 4/1990 | Morito | 395/2.42 |
| 4,959,865 | 9/1990 | Stettiner et al. . | |
| 4,972,490 | 11/1990 | Thomson | 395/2.17 |
| 5,097,510 | 3/1992 | Graupe | 381/47 |
| 5,276,765 | 1/1994 | Freeman | 395/2.42 |

FOREIGN PATENT DOCUMENTS

| | | |
|---|---|---|
| 0 335 521 | 4/1989 | European Pat. Off. . |
| 0 459 363 | 4/1991 | European Pat. Off. . |

OTHER PUBLICATIONS

IEEE Trans. on ASSP vol. 27, No. 2, Apr. 1979 pp. 113–120.
ICASSP 85 vol. 4, 26 Mar. 1985, Tampa, Florida p. 1838.
ICASSP 91 vol. 1, 14 May 1991, Toronto pp. 733–736.

*Primary Examiner*—Allen R. MacDonald
*Assistant Examiner*—Thomas J. Onka
*Attorney, Agent, or Firm*—Oblon, Spivak, McClelland, Maier & Neustadt, P.C.

[57] ABSTRACT

A method for detecting the start and end of speech from a noisy signal including the steps of:

detecting a voiced frame;

searching for noise frames preceding this voiced frame;

constructing an autoregressive model of the noise and a mean noise spectrum;

bleaching the flames preceding the voicing, searching for the actual start of speech in the bleached frames;

removing the noise from the voiced frames and parameterizing them; and searching for the actual end of speech.

11 Claims, 6 Drawing Sheets

METHOD OF SPEECH DETECTION

FIELD OF THE INVENTION

The present invention relates to a method of speech detection.

BACKGROUND OF THE INVENTION

When seeking to determine the actual start and end of speech, various solutions can be envisioned:

(1) It is possible to work with the instantaneous amplitude by reference to an experimentally determined threshold and confirm the speech detection by a detection of voicing (see article "Speech—noise discrimination and its applications" by V. Petit/F. Dumont, which appeared in the THOMSON-CSF Technical Magazine—Vol. 12—No. 4, Dec. 1980).

(2) It is also possible to work with the energy of the total signal over a time slice of duration T, by thresholding this energy, still experimentally, with the aid of local histograms, for example, and then to confirm subsequently with the aid of a voicing detection, or of the calculation of the minimum energy of a vowel. The use of the minimum energy of a vowel is a technique described in the report "AMADEUS Version 1.0" by J. L. GAUVAIN of the LIMSI laboratory of the CNRS.

(3) The preceding systems allow detection of voicing, but not of the actual start and end of speech, that is to say the detection of unvoiced fricative sounds (/F/, /S/, /CH/) and unvoiced plosive sounds (P/, /T/, /Q/). It is therefore necessary to supplement them by an algorithm for detecting these fricatives. A first technique may consist in the use of local histograms, as recommended by the article "Problem of detection of the boundaries of words in the presence of additive noise" by P. WACRENIER, which appeared in the PhD thesis from the PARIS-SUD university, Centre d'Orsay.

Other techniques close to the preceding ones and relatively close to that set out here have been presented in the article "A Study of Endpoint Detection Algorithms in Adverse Conditions: Incidence on a DTW and HMM Recognizer" by J. C. JUNQUA/B. REAVES/B. MAK, during the EUROSPEECH Congress, 1991.

In all these approaches, a large part is done heuristically, and few powerful theoretical tools are used.

Works on noise removal from speech, similar to those presented here, are much more numerous, and mention will be made in particular of the book "Speech Enhancement" by J. S. LIM in the Prentice-Hall Signal Processing Series publications "Suppression of Acoustic Noise in Speech Using Spectral Subtraction" by S. F. BOLL, which appeared in the magazine IEEE Transactions on Acoustics, speech and signal processing, Vol. ASSP-27, No. 2, April 1989, and "Noise Reduction for Speech Enhancement in Cars: Non-Linear Spectral Subtraction/Kalman Filtering" by P. LOCKWOOD, C. BAILLARGEAT, J. M. GILLOT, J. BOUDY, G. FAUCON which appeared in the EUROSPEECH 91 magazine. Only techniques for noise removal in the spectral domain will be quoted, and mention will be made in the rest of the text of "spectral" noise removal by use of this language.

In all these works, the close relationship between detection and noise removal is never really brought into the open, except in the article "Suppression of Acoustic Noise in Speech using detection and raction", which proposes an empirical solution to this problem.

However, it is obvious that removal of noise from speech, when two recording channels are not available, necessitates the use of frames of "pure" noise, which are not contaminated by speech, which makes it necessary to define a detection tool capable of distinguishing between noise and noise+speech.

SUMMARY OF THE INVENTION

The subject of the present invention is a method of detection and of noise removal from speech which makes it possible to detect, as reliably as possible, the actual starts and ends of speech signals whatever the types of speech sounds, and which makes it possible, as effectively as possible, to remove noise from the signals thus detected, even when the statistical characteristics of the noise affecting these signals vary greatly.

The method of the invention consists of carrying out a detection of voiced frames in a slightly noisy medium, and in detecting a vocal kernel to which a confidence interval is attached.

In a noisy medium, after having carried out the detection of at least one voiced frame, noise frames preceding this voiced frame are sought, an autoregressive model of noise and a mean noise spectrum are constructed, the frames preceding the voicing are bleached by rejector filter and noise is removed by spectral noise removal, the actual start of speech is sought in these bleached frames, the acoustic vectors used by the voice recognition system are extracted from the noise-removed frames lying between the actual start of speech and the first voiced frame as long as voiced frames are detected, the latter have the noise removed and then are parametrized for the purpose of recognizing them (that is to say that the acoustic vectors suitable for recognition of these frames are extracted), when no more voiced frames are detected, the actual end of speech is sought, the frames lying between the last voiced frame and the actual end of speech have the noise removed and are then parametrized.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
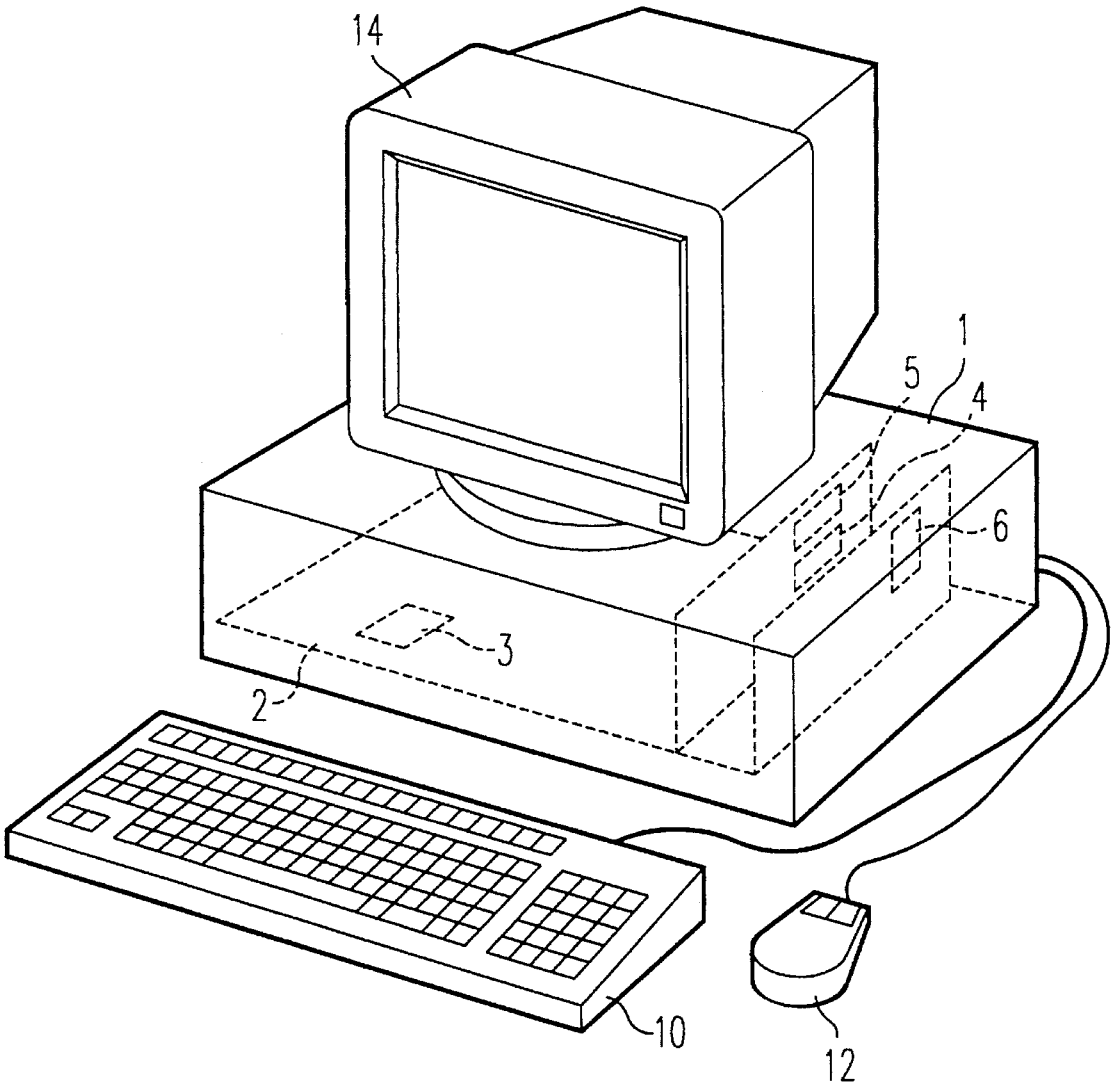
FIG. 1 is a schematic representing a computer system for implementing the method of the present invention.

In referring now to the drawings, wherein like reference numerals designate identical or corresponding parts throughout the several views, FIG. 1 is a view showing a computer for implementing the method of the present invention. Within a computer system 1, a motherboard 2 houses a central processing unit 3 and a memory card 4 comprising plural memory chips 5. Furthermore, to implement the lowest level processing of the present invention, a digital signal processing chip 6 is also included in computer system 1. Normal input output devices, i.e. keyboard 10, mouse 12 and monitor 14, are also provided.

Figure 2A:
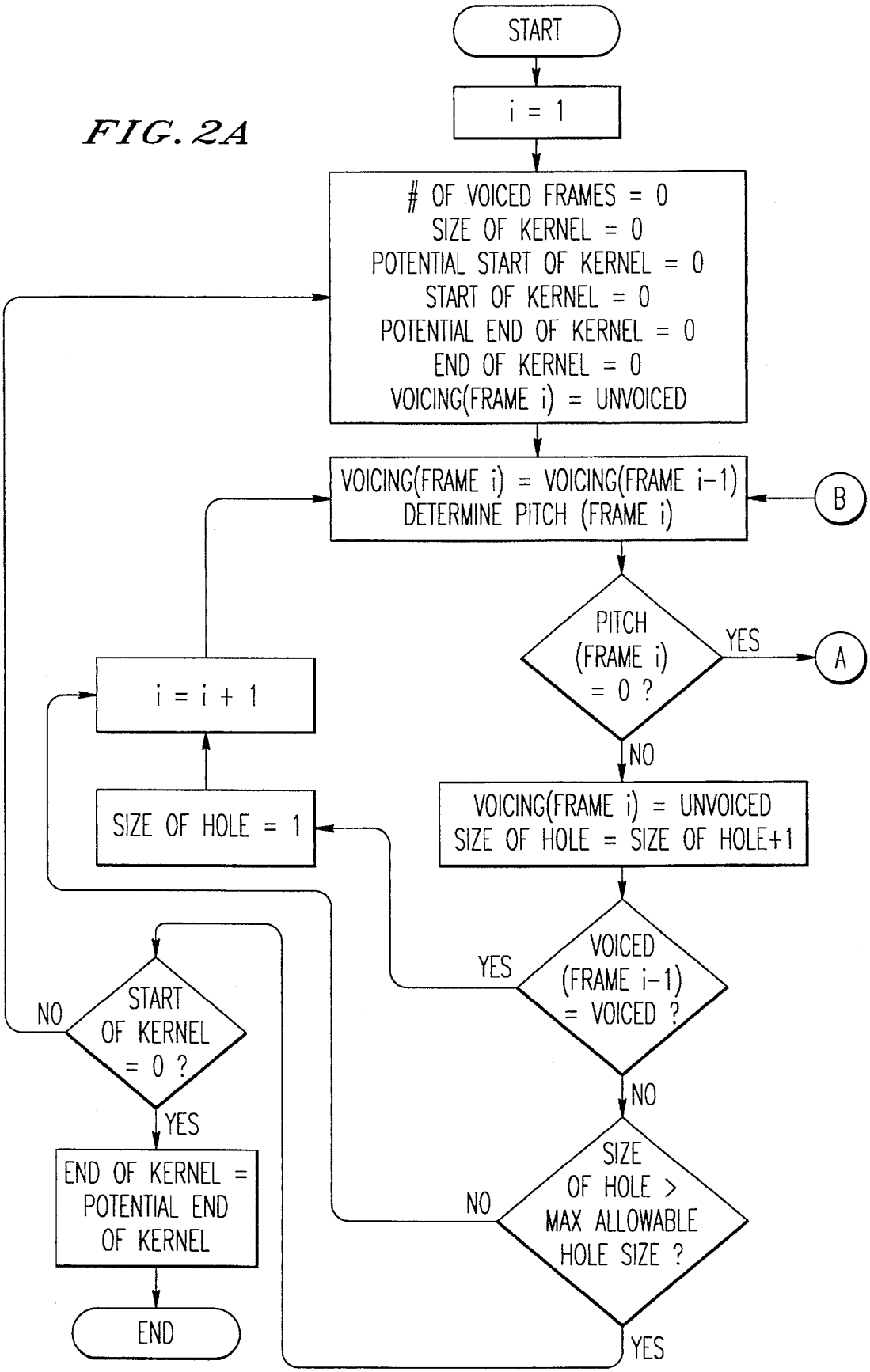
FIGS. 2A and 2B are flowcharts depicting the method of the present invention for determining the actual start and end of speech from a sample speech input.
Figure 2B:
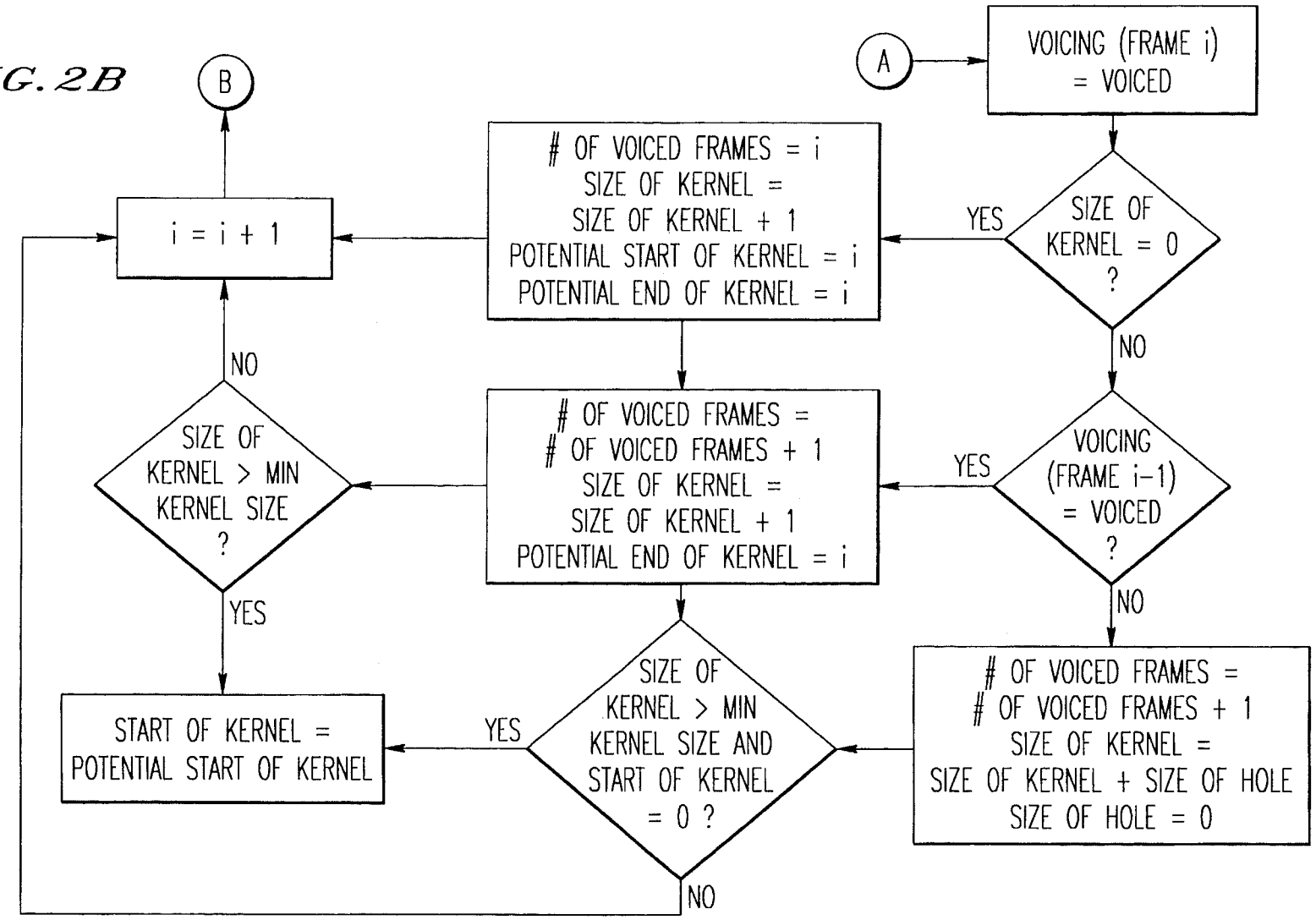
Figure 3:
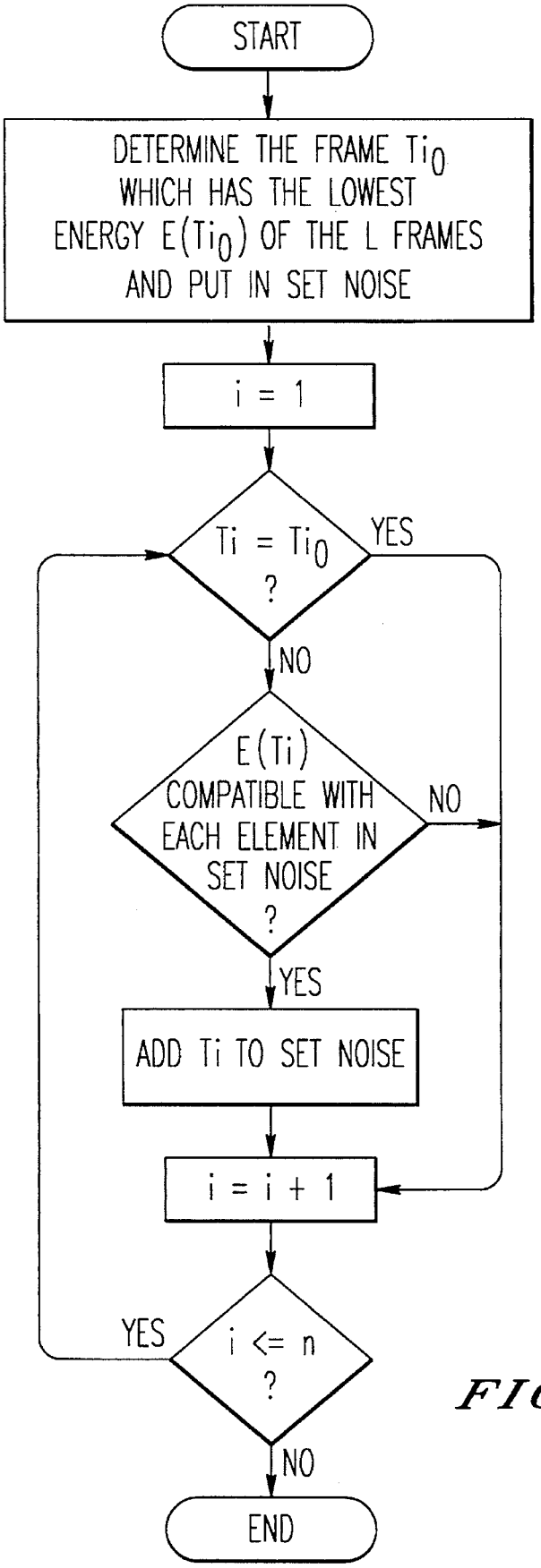
FIG. 3 is a flowchart depicting a noise detection algorithm used to determine which frames before the voiced frames are noise frames.
Figure 4:
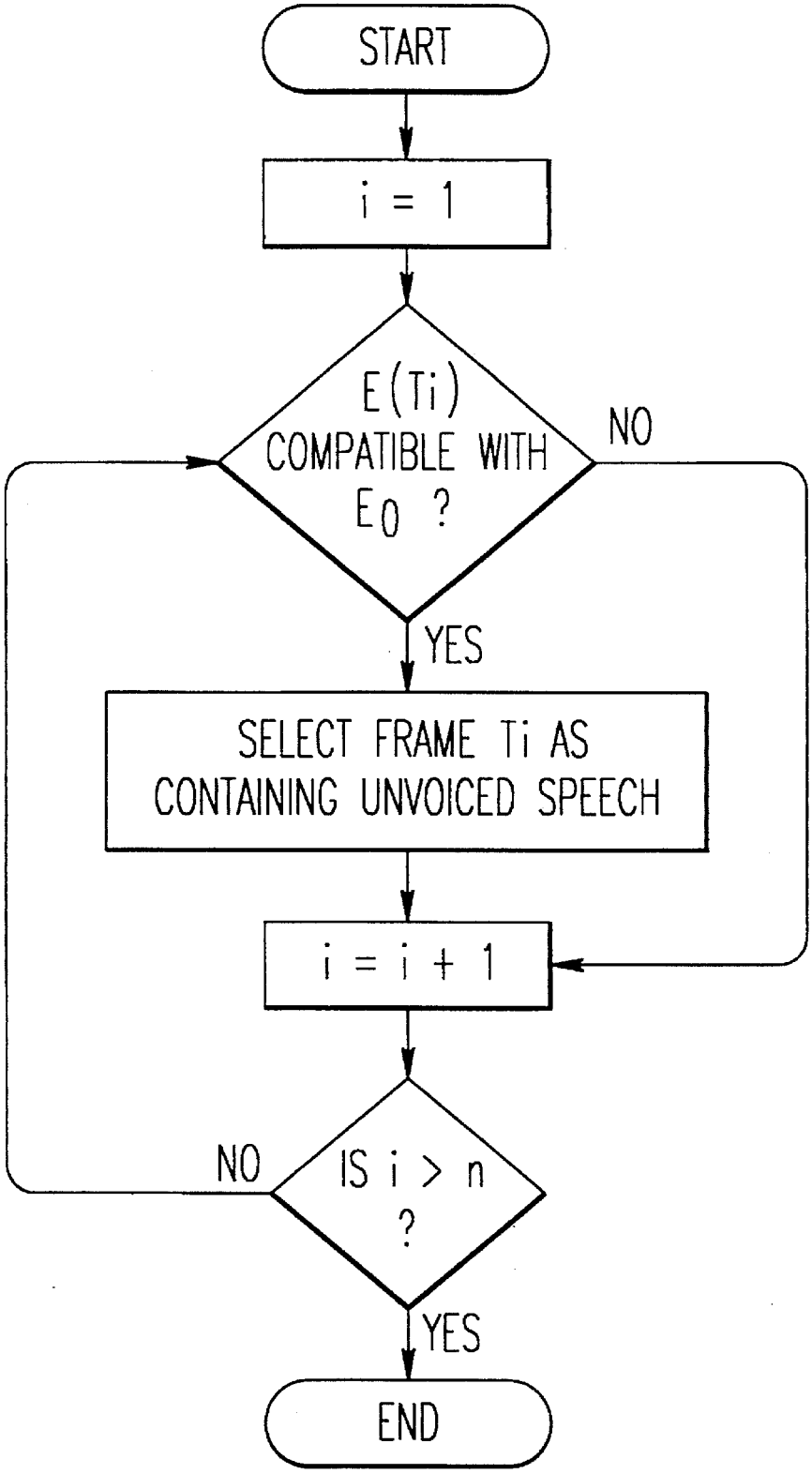
FIGS. 4 and 5 are flowcharts depicting a first and second embodiment of the method of detecting the unvoiced sound in the detected speech input after the voiced frames.
Figure 5:
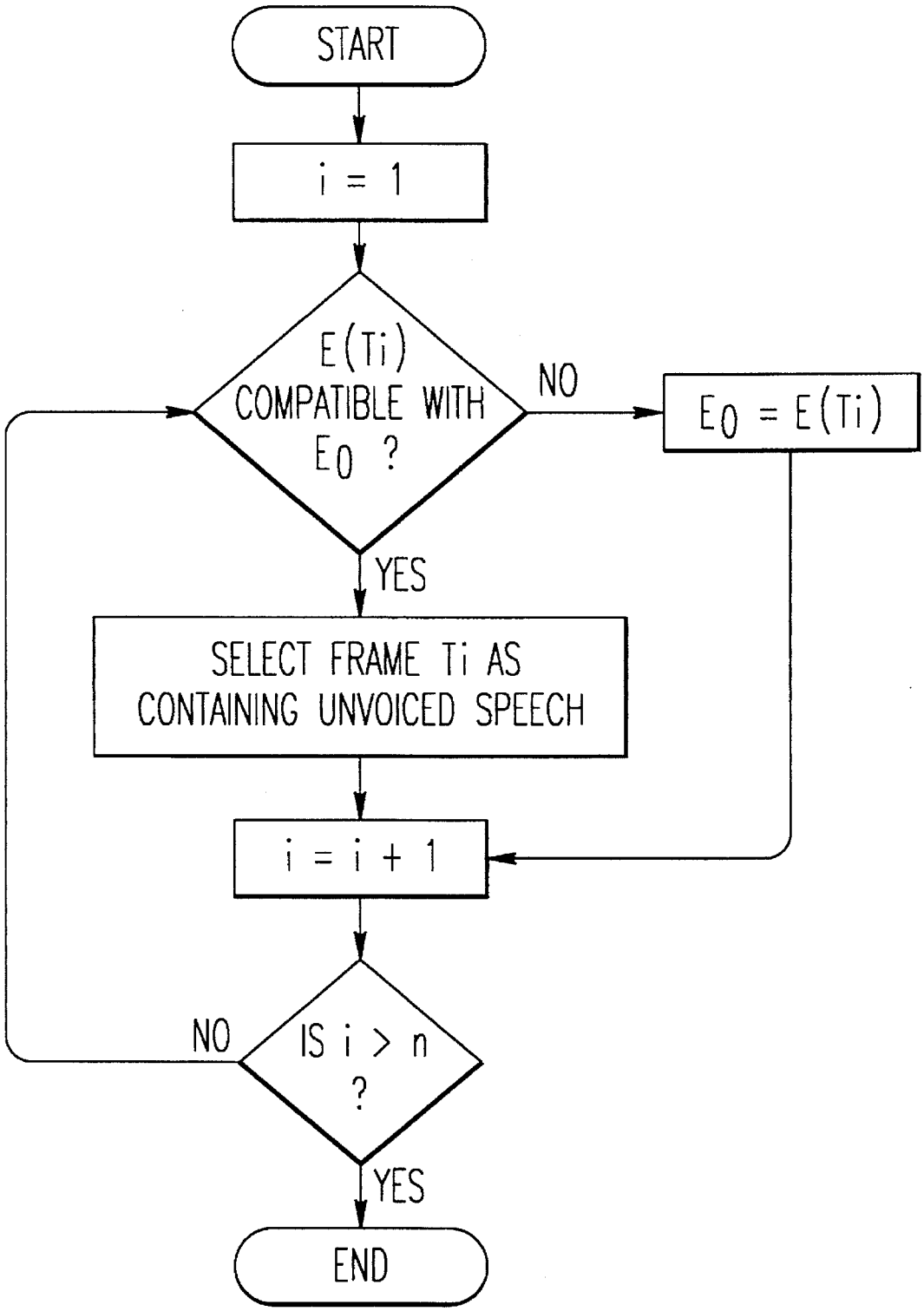

FIG. 2 shows the method of the present invention for determining an actual start and end of speech received from a speech input.

Throughout the following, when mention is made of parametrization of the frames, it should be understood that the acoustic vector (or, in an equivalent way, the acoustic parameters) used by the recognition algorithm are extracted from the frame.

One example of such acoustic parameters are the cepstrum coefficients which are well known to specialists in speech processing.

Throughout the following, bleaching will be understood to mean the application of a rejector filter calculated on the basis of the autoregressive model of the noise, and, by noise removal, the application of the spectral noise remover.

Bleaching and spectral noise removal are not applied sequentially, but in parallel, the bleaching allowing detection of unvoiced sounds, noise removal improving the quality of the voice signal to be recognized.

Hence, the method of the invention is characterized by the use of theoretical tools allowing a rigorous approach to the detection problems (voicing and fricatives), by its great adaptability, as this method is, above all, a method local to the word. The statistical characteristics of the noise may change over time, the method will remain capable of adapting thereto, by construction. It is also characterized by the formulation of detection assessments on the basis of results from signal processing algorithms (the number of false alarms, due to the detection, is thus minimized, by taking into account the particular nature of the speech signal), by noise-removal processes coupled to speech detection, by a "real time" approach, at every level of the analysis, by its synergy with other techniques for voice signal processing, by the use of two different noise removers:

* Rejection filtering, used mainly for detection of fricatives, by virtue of its bleaching properties.
* Wiener filtering in particular, used for removing noise from the speech signal for the purposes of its recognition. It is also possible to use spectral subtraction.

Three processing levels must therefore be distinguished in the method of the invention:

The "elementary" level which implements signal processing algorithms which are in fact the basic elements of all the higher-level processing.

Thus, the "elementary" level of voicing detection is a calculating and thresholding algorithm for the correlation function. The result is assessed by the higher level.

These processings are implemented into signal processing processors, for example DSP 96000.

The intermediate assessment level formulates "intelligent" detections of voicing and of beginnings of speech, taking into account the "raw" detection supplied by the elementary level. The assessment is implemented using an appropriate computer language, such as those relating to Prolog.

The "upper" or user level manages the various detection, noise removal and analysis algorithms of the voice signal in real time. The C language, for example, is appropriate for implementation of this management.

The invention is described in detail below according to the following plan. There is first of all a description of the algorithm which makes it possible to suitably concatenate the various signal processing techniques and assessments necessary.

It will be assumed at this highest processing level in the design hierarchy that reliable detection and noise removal methods are available, including all the necessary and sufficient signal processing algorithms and assessments. This description is therefore very general. It is even independent of the assessment and signal processing algorithms described below. It may therefore be applied to techniques other than those described here.

Next there is a description of the assessments for detection of voicing, for determining the start and end of speech, with the aid of elementary-level algorithms, of which a few examples are quoted.

Finally there is a description of the methods used for detection of and noise removal from speech.

It is the results of these techniques (voiced speech, unvoiced speech, etc.) which are used by the upper processing levels.

Conventions and vocabulary used

The elementary time unit of processing will be called a frame. The duration of a frame is conventionally 12.8 ms, but may, needless to say, have different values (realizations in mathematical language). The processings make use of discrete Fourier transforms of the processed signals. These Fourier transforms are applied to the set of samples obtained over two consecutive frames, which corresponds to carrying out a Fourier transform over 25.8 ms.

When two Fourier transforms are consecutive in time, these transforms are calculated, not over four consecutive frames, but over three consecutive frames with an overlap of one frame. This is illustrated by the following diagram:

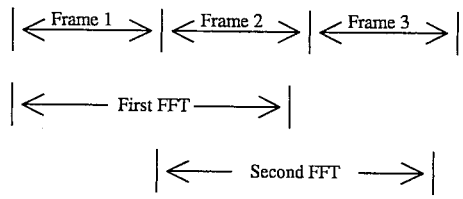

Here the operation of the algorithm at the design level closest to the user will be described first.

The preferred implementation of the invention is described below with reference to the analysis of signals originating from very noisy avionic environments, which makes it possible to have available start information which is the microphone switching which the pilots use. This information indicates a time area close to the signal to be processed.

However, this switching may be more or less close to the actual start of the speech, and it is therefore possible to assign to it only slight credit for any precise detection. It will therefore be necessary to specify the actual start of speech from this first information.

Firstly, the first voiced frame situated in the vicinity of this switching is sought. This first voiced frame is sought first of all among the N1 frames which precede the switching (N1=about 30 frames). If this voiced frame is not found among these N1 frames, then voicing is sought on the frames which follow the switching, at the rate at which they turn up.

As soon as the first voiced frame is found by this method, the noise removers will be initialized. In order to do that, it is necessary to bring to light frames consisting solely of noise. These noise frames are sought among the N2 frames which precede the first voiced frame (N2=about 40 frames). In fact, each of these N2 frames is either:

* constituted by noise alone
* constituted by noise+breathing
* constituted by noise+fricative or unvoiced occlusive.

The hypothesis made is that the energy of the noise is, on average, less than that of the noise+breathing, which is itself less than that of the noise+fricative.

Hence, if, among the N2 frames, the one which presents the lowest energy is considered, it is highly probable that this frame consists only of noise.

Starting from knowing this frame, all those which are compatible with it are sought, and those compatible 2 by 2, in the sense given later, in the paragraph "compatibilities between energies", When the noise frames have been detected, the two noise models, which will be of service later are constructed:

* Autoregressive model of the noise making it possible to construct the rejector filtering which bleaches the noise.
* Mean noise spectrum for spectral noise removal.

These models are described below.

Once the noise models have been constructed, the N3 frames (N3=about 30 frames) which precede the voicing, and among which the actual start of speech will be sought, are bleached (by using the rejector filter) and their noise is removed (by using the spectral noise remover). It also goes without saying that N3 is less than N2. This detection is done by fricative detection and is described below.

When the start of speech is known, the noise is removed from all the frames lying between the start of speech and the first voiced frame, then these frames are parametrized for the purpose of their recognition. As fast as these frames have their noise removed and are parametrized, they are sent to the recognition system.

Since the actual start of speech is known, it is possible to carry on processing the frames which follow the first voiced frame.

Each frame acquired is no longer bleached but only freed of noise, then each frame is parametrized for its recognition. A voicing test is carried out on each frame.

If this frame is voiced, the acoustic vector is actually sent to the recognition algorithm.

If it is not voiced, it is examined to see whether it is in fact the last frame of the current voice kernel.

If it is not the last frame of the voice kernel, a new frame is acquired and the method is reiterated, up to the moment when the last voiced frame is found.

When the last voiced frame is found, the N4 frames which follow this last voiced frame are bleached (N4 =about 30 frames), then the actual end of speech is sought among these N4 bleached frames. The method associated with this detection is described below.

When the actual end of speech is detected, the frames lying between the end of voicing and this end of speech are freed of noise then parametrized and sent to the pure voice recognition system.

When the last speech frame has been freed of noise, parametrized and sent to the recognition system, all the processing parameters are reinitialized, so that the spoken sound can be processed.

As can be seen, this method is local to the spoken sound processed (that is to say that it processes each phrase or each set of words without a "hole" between words), and thus makes it possible to be very adaptive to any change in statistics of the noise, all the more so since adaptive algorithms are used for auto-regressive modeling of the noise, as well as relatively sophisticated theoretical models for detection of noise frames and detection of fricatives.

In the absence of switching, the method is implemented as soon as voicing is detected.

A significant simplification of the method described above is possible when the signals processed are not very noisy. The use of noise removal and bleaching algorithms may then turn out to be pointless, or even harmful, when the noise level is negligible (laboratory environment). This phenomenon is known, especially in the case of noise removal, in which removing the noise from a signal which is only very slightly noisy may induce a deformation of the speech which is prejudicial to correct recognition. The method can be simplified by:

withdrawing the spectral noise removal for recognition so that any deformation of the speech, is a voiced, and not compensating for the gain in signal-to-noise ratio which could be obtained by noise removal, and thus be prejudicial to correct recognition; and withdrawing the bleaching filter (and thus of the calculation of the autoregressive model of the noise, which also implies the withdrawal of the noise confirmation module). This withdrawal is not absolutely necessary in a slightly noisy environment. Prior tests are preferable to decide thereon.

The procedures for assessment of voicing detection and fricative detection will now be set out in detail.

These assessment procedures make use of well known signal processing and detection tools, which provide many automatic basic units, whose ability is to decide, in a coarse way, whether the frame processed is voiced or not, is an unvoiced fricative or unvoiced plosive frame, etc.

The assessment consists in combining the various results obtained with the aid of said tool, in such a way as to bring to light coherent assemblies, forming the vocal kernel for example, or blocks of unvoiced fricative sounds (plosives).

By nature, the language for implementation of such procedures is preferably PROLOG.

With the difference of the process described above, this assessment is the same whether the medium is noisy or not.

For the voicing detection assessment, a known voicing detection process is used, which, for a given frame, decides whether this frame is voiced or not, by returning the value of the pitch associated with this frame. The pitch is the repetition frequency of the voicing pattern. This pitch value is zero if there is no voicing, and non-zero otherwise.

This elementary voicing detection is done without using results based on the preceding frames, and without predicting the result based on the future frames.

As a voice kernel may consist of several voiced segments, separated by unvoiced holes, assessment is necessary so as to validate the voicing or otherwise.

The general rules of the assessment will now be set out. Rule 1: Between two voiced frames which are consecutive or separated by a relatively small number of frames (of the order of three or four frames), the pitch values obtained may not differ by more than a certain delta (about ±20 Hz depending on the speaker). On the other hand, when the offset between two voiced frames exceeds a certain number of frames, the pitch value may change very quickly. Rule 2: A vocal kernel consists of voiced frames intercut by holes. These holes must satisfy the following condition: The size of a hole must not exceed a maximum size, which may depend on the speaker and above all on the vocabulary (about 40 frames). The size of the kernel is the sum of the number of voiced frames and of the size of the holes of this kernel. Rule 3: The actual start of the vocal kernel is given as soon as the size of the kernel is sufficiently great (about 4 frames). Rule 4: The end of the vocal kernel is determined by the last voiced frame followed by a hole exceeding the maximum permitted size for a hole in the vocal kernel. Progress of the assessment The preceding rules are used in the way set out below, and when a pitch value has been calculated.

First part of the assessment:

The calculated value of the pitch is validated or not, depending on the value of the pitch of the preceding frame and of the last non-zero value of the pitch, this being done as a function of the number of frames separating the currently processed frame and that of the last non-zero pitch. This corresponds to the application of Rule 1.

Second part of the assessment:

This second part of the assessment is broken down according to different cases. Case 1: First voiced frame:

The possible size of the kernel is incremented, and is therefore equal to 1

The possible start of the vocal kernel is therefore the current frame

The possible end of the vocal kernel is therefore the current frame Case 2: The current frame is voiced as is the preceding one.

A voiced segment is therefore processed.

The possible number of voiced frames of the kernel is incremented

The possible size of the kernel is incremented

The possible end of the kernel may be the current frame which is also the possible end of the segment.

If the size of the kernel is sufficiently great (about four frames, as detailed above). And if the actual start of the vocal kernel is not known.

Then:

The start of the kernel is the first frame detected as voiced.

This corresponds to the implementation of Rule 3. Case 3: The current frame is not voiced, whereas the preceding frame is. The first frame of a hole is being processed.

The size of the hole is incremented, passing to 1 Case 4: The current frame is not voiced and neither is the preceding one.

A hole is being processed.

The size of the hole is incremented.

If the size of the hole exceeds the maximum size allowed for a hole of the vocal kernel, Then:

If the actual start of the voicing is known,

Then:

The end of the vocal kernel is the last voiced frame determined before this hole. The assessment is stopped and all the data are reinitialized for processing the next spoken sound (cf. Rule 4).

If the actual start of speech is still not known,

Then:

The assessment is continued over the following frames after reinitialization of all the parameters used, as those which were updated previously are not valid.

Else, this hole possibly forms part of the vocal kernel and the definitive decision cannot yet be taken. Case 5: The current frame is voiced and the preceding one is not.

A hole has just been finished, and a new voiced segment is started.

The number of voiced frames of the kernel is incremented.

The size of the kernel is incremented.

If the hole which has just been finished may form part of the vocal kernel (that is to say if its size is less than the maximum size allowed for a hole according to Rule 2).

Then:

The size of this hole is added to the current size of the kernel.

The size of the hole is reinitialized, for processing of the next unvoiced frames.

If the actual start of the voicing is not yet known,

And if the size of the kernel is sufficient from here on (Rule 3),

Then:

The start of the voicing is the start of the voiced segment preceding the hole which has just been terminated.

Else, this hole cannot form part of the vocal kernel:

If the actual start of the voicing is known,

Then:

The end of the vocal kernel is the last voiced frame determined before this hole. The assessment is stopped and all the data are reinitialized for processing the next spoken sound. (cf. Rule 4).

If the actual start of voicing is still not known,

Then:

The assessment is continued over the following frames after reinitialization of all the parameters used, as those which were updated previously are not valid.

This procedure is used for each frame, and after calculation of the pitch associated with each frame.

Assessment for detection of unvoiced speech.

A process known per se for detection of unvoiced speech is used here.

This elementary detection of voicing is done without using results bearing on the preceding frames, and without predicting the result bearing on the future frames.

Unvoiced speech signals placed at the start or at the end of the spoken sound may be constituted by:

a single fricative segment as in "chaff"

a fricative segment followed by an occlusive segment as in "stop"

of a single occlusive segment as in "parole"

There is thus the possibility of holes in the set of unvoiced frames.

Moreover, such fricative blocks must not be too large. Hence, assessment taking place after the detection of these sounds is necessary.

In what follows, the "term fricative" will refer equally well to unvoiced fricatives as to unvoiced plosives.

General rules of the assessment.

The assessment set out here is similar to that described above in the case of voicing. The differences arise essentially in taking account of new parameters which are the distance between the vocal kernel and the fricative block, and the size of the fricative block. Rule 1: the distance between the vocal kernel and the first fricative frame detected must not be too great (about 15 frames maximum). Rule 2: the size of a fricative block must not be too large. This means, in the same way, that the distance between the vocal kernel and the last frame detected as fricative must not be too great (about 10 frames maximum). Rule 3: the size of a hole in a fricative block must not exceed a maximum size (about 15 frames maximum), The total size of the kernel is the sum of the number of voiced frames and of the size of the holes in this kernel. Rule 4: the actual start of the fricative block is determined as soon as the size of a segment has become sufficient, and the distance between the vocal kernel and the first frame of this processed fricative segment is not too large, in accordance with Rule 1. The actual start of the fricative block corresponds to the first frame of this segment. Rule 5: the end of the fricative block is determined by the last frame of the fricative block followed by a hole exceeding the maximum size allowed for a hole in the vocal kernel, and when the size of the fricative block thus determined is not too large in accordance with Rule 2.

Progress of the assessment.

This assessment is used to detect the fricative blocks preceding the vocal kernel or following it. The benchmark chosen in this assessment is therefore the vocal kernel.

In the case of detection of a fricative block preceding the vocal kernel, the processing is done starting from the first voicing frame, thus by "ascending" in time. Hence, when it is said that a frame i follows a frame j (previously processed), it should be understood thereby, with respect to this first frame of the vocal kernel. In reality, the frame j is chronologically subsequent to frame i. What is named start of the fricative block in the assessment described below is in fact, chronologically, the end of this block, and what is called end of the fricative block is in fact the chronological start of this block. The distance between vocal kernel and frame detected as fricative is the distance between the first frame of the voiced block and this fricative frame.

In the case of the detection of a fricative block situated after the vocal kernel, the processing is done after the last voiced frame, and thus follows the natural chronological order, and the terms of the assessment are perfectly adequate. Case 1: As long as there is no fricative detection, a hole is present which follows the vocal kernel and precedes the fricative block.

The distance between the voiced segment and the fricative block is incremented. This distance thus calculated is a lower limit of the distance between the fricative block and the vocal kernel. This distance will be fixed as soon as the first fricative frame is detected. Case 2: First fricative detection. Processing of a fricative segment is starting.

The size of the fricative block is initialized to 1.

The distance between the voiced block and the fricative block is fixed. If the distance between the vocal kernel and the fricative block is not too great (in accordance with Rule 2).

Then:

The possible start of the fricative block may be the current frame.

The possible end of the fricative block may be the current frame.

If the size of the fricative block is sufficiently great

And if the actual start of the fricative block is not yet known, then:

the start of the kernel may be confirmed.

It will be noted that this If (in "If the size of the fricative block is sufficiently great") is pointless if the minimum size for a fricative block is greater than one frame, but when it is sought to detect occlusives in a noisy medium, the latter may appear only over the duration of a single frame. It is therefore necessary to take the minimum size of a fricative block equal to 1, and to keep this condition. If the distance between the vocal kernel and the fricative block is too great (cf. Rule 2).

There is no acceptable fricative block.

Reinitializing is done for processing the next spoken sound.

The processing is exited.

As the test on the distance between vocal kernel and fricative block is carried out as from the first fricative detection, it will not be renewed in the following cases, all the more so as if this distance is too great here the procedure is stopped for this spoken sound. Case 3: The current frame and the preceding one are both fricative frames. A frame is being processed which is situated fully in an acceptable fricative segment (situated at a correct distance from the vocal kernel in accordance with rule 1).

The possible end of the fricative block is the current frame.

The size of the fricative block is incremented.

If the size of the fricative block is sufficiently great (cf. rule 4). And if the size of this block is not too great (cf. rule 2). And if the actual start of the fricative block is not yet known, then:

the start of the kernel may be confirmed as being the start of this fricative segment. Case 4: The current frame is not a fricative in contrast to the preceding frame.

The first frame of a hole situated within the fricative block is being processed.

The total size of the hole (which becomes equal to 1) is incremented. Case 5: Neither the current frame nor the preceding one are fricative frames.

A frame is being processed situated fully in a hole of the fricative block.

The total size of the hole is incremented.

If the current size of the fricative block increased by the size of the hole is greater than the maximum size allowed for a fricative block (rule 2). Or if the size of the hole is too great.

If the start of the fricative block is known, then:

The end of the fricative block is the last frame detected as fricative.

All the data are reinitialized so as to process the next spoken sound.

Else:

all the data are reinitialized, even those which have previously been updated, as they are no longer valid.

The next frame is then processed. Else, this hole may perhaps form part of the fricative block and the definitive decision can not yet be taken. Case 6: The current frame is a fricative frame in contrast to the preceding frame. The first frame of a fricative segment situated after a hole is processed.

The size of the fricative block is incremented. If the current size of the fricative block increased by the size of the previously detected hole is greater than the maximum size allowed for a fricative block, Or if the size of the hole is too great, then:

If the start of the fricative block is known, then:

The end of the fricative block is then the last frame detected as fricative.

All the data are reinitialized so as to process the next spoken sound.

Else,

All the data are reinitialized, even those which have previously been updated, as they are not valid. The next frame is then processed.

Else, (the hole forms part of the fricative segment).

The size of the fricative block is increased by the size of the hole

The size of the hole is reinitialized to 0

If the size of the fricative block is sufficiently great

And if this size is not too great

And if the actual start of the fricative block is not known

Then:

The start of the kernel may be confirmed.

Simplification in the case of a medium which is only slightly noisy.

In the case in which the user assesses that the medium is insufficiently noisy to necessitate the preceding sophisticated processing, it is possible not only to simplify the assessment presented above, but even to eliminate it. In this case, speech detection will be reduced to a simple detection of the vocal kernel to which a confidence interval is attached, expressed in number of frames, which turns out to be adequate to improve the performance of a voice recognition algorithm. It is thus possible to start the recognition about ten, or even fifteen frames before the start of the vocal kernel, and to complete it about ten or even fifteen frames after the vocal kernel. Signal Processing Algorithms.

The calculating procedures and methods described below are the components used by the assessment and management algorithms. Such functions are advantageously implemented into a signal processor and the language used is preferably Assembler.

For detection of voicing in a medium which is only slightly noisy, a beneficial solution is A.M.D.F. (Average Magnitude Difference Function) thresholding, the description of which may be found, for example, in the work "Speech Processing" by R. Boite/M. Kunt which appeared in the Presses Polytechniques Romandes publications.

The AMDF is the function $D(k)=\Sigma_n|x(n+k)-x(n)|$. This function is bounded by the correlation function, according to: $D(k)\leqq 2(\Gamma_x(O)-\Gamma_x(k))^{1/2}$. This function therefore exhibits "peaks" downwards, and must therefore be thresholded like the correlation function.

Other methods based on calculation of the spectrum of the signal can be envisaged, for results which are entirely acceptable ("speech processing" article mentioned above). However, it is beneficial to use the AMDF function, for simple reasons of calculating costs.

In a noisy medium, the AMDF function is a distance between the signal and its delayed form. However, this distance is a distance which does not allow an associated scalar product, and which thus does not allow the notion of orthogonal projection to be introduced. However, in a noisy medium, the orthogonal projection of the noise may be zero, if the projection axis is properly chosen. The AMDF is therefore not an adequate solution in a noisy medium.

The method of the invention is thus based on correlation, as correlation is a scalar product and performs an orthogonal projection of the signal on its delayed form. This method is, thereby, more robust as regards noise than other techniques, such as AMDF. In effect, let's assume that the observed signal is $x(n)=-s(n)+b(n)$ in which $b(n)$ is a white noise independent of the useful signal $s(n)$. The correlation function is, by definition: $\Gamma_x(k)=E[x(n)x(n-k)]$, thus $\Gamma_x(k)=E[s(n)s(n-k)]+E[b(n)b(n-k)]=\Gamma_s(k)+\Gamma_b(k)$ As the noise is white: $\Gamma_x(O)=\Gamma_s(O)+\Gamma_b(O)$ and $\Gamma_x(k)=\Gamma_S(k)$ for $k\neq O$.

The whiteness of the noise in practice is not a valid hypothesis. However, the result remains a good approximation as soon as the correlation function of the noise decreases rapidly, and for sufficiently large k as in the case of pink noise (white noise filtered by a bandpass), in which the correlation function is a cardinal sine, and thus practically zero as soon as k is sufficiently great.

A procedure for pitch calculation and pitch detection, applicable to noisy media as well as to media which are only slightly noisy will now be described.

Let $x(n)$ be the processed signal in which $n\in\{0,\ldots,N-1\}$.

In the case of the AMDF, $r(k)=D(k)=\Sigma_n|x(n+k)-x(n).|$

In the case of correlation, the expected value allowing access to the correlation function can only be estimated, such that the function $r(k)$ is: $r(k)=K\,\Sigma_{0\leqq n\leqq N-1}x(n)x(n-k)$ in which K is a calibration constant.

In both cases, the value of the pitch is obtained theoretically by proceeding as follows: $r(k)$ is a maximum at $k=0$. If the second maximum of $r(k)$ is obtained at $k=k_0$, then the value of the voicing is $F_0=F_e/k_0$ in which $F_e$ is the sampling frequency.

However, this theoretical description has to be revised in practice.

In fact, if the signal is known only over the samples 0 to N−1, then $x(n-k)$ is taken to be zero as long as n is not greater than k. There will therefore not be the same number of calculating points from one value k to the next. For example, if the pitch bracket is taken to be equal to [100 Hz, 333 Hz], this for a sampling frequency of 10 kHz, the index $k_1$ corresponding to 100 Hz is equal to: $k_1=F_e/F_0=10000/100=100$ and that corresponding to 333 Hz is equal to $k_2=F_e/F_0=10000/333=30$.

The calculation of the pitch for this bracket will therefore be done from k=30 to k=100.

If, for example, 256 samples are available (2 frames of 12.8 ms sampled at 10 kHz), the calculation of r(30) is done from n=30 to n=128, i.e. over 99 points and that of r(100) from n=100 to 128, i.e. over 29 points.

The calculations are therefore not homogeneous from one to the next and do not have the same validity.

For the calculation to be correct, it is necessary for the observation window always to be the same, whatever k is. So much so that if n−k is less than 0, it is necessary to have kept the past values of the signal $x(n)$ in memory, so as to calculate the function $r(k)$ over as many points, whatever k is. The value of the constant K no longer matters.

This is prejudicial to the calculation of the pitch only over the first actually voiced frame, since, in this case, the samples used for the calculation originate from an unvoiced frame, and are therefore not representative of the signal to be processed. However, as from the third consecutive voiced frame, when working, for example, with frames of 128 points sampled at 10 kHz, the calculation of the pitch will be valid. This assumes, in general, that voicing lasts a minimum of 3×12.8 ms, which is a realistic hypothesis. This hypothesis will have to be taken into account during the assessment, and the minimal duration for validating a voiced segment will be 3×12.8 ms in this same assessment.

With this function $r(k)$ calculated, it is then a question of thresholding it. The threshold is chosen experimentally, according to the dynamic range of the signals processed. Hence, in one application example, in which quantification is done over 16 bits, in which the dynamic range of the samples does not exceed ±10,000, and in which the calculations are done for N=128 (sampling frequency of 10 kHz), the choice is Threshold=750,000. But let us remember that these values are given only by way of example for particular applications, and have to be modified for other applications. In any event, that does not change anything in the methodology described above. The method of detecting noise frames will now be set out.

Outside the vocal kernel, the signal frames which may be encountered are of three types:

1) noise alone 2) noise+unvoiced fricative 3) noise+breathing.

The detection algorithm aims to detect the start and the end of speech from a bleached version of the signal, while the noise removal algorithm necessitates knowledge of the mean noise spectrum. In order to construct the noise models which will make it possible to bleach the speech signal for the purposes of detecting unvoiced sounds as described below, and for removal of noise from the speech signal, it is obvious that it is necessary to detect the noise frames, and to confirm them as such. This search for the noise frames is done among a number of frames $N_1$ defined by the user once and for all for his application (for example for $N_1=40$), these $N_1$ frames being situated before the vocal kernel.

Let us remember that this algorithm allows the implementation of noise models, and is therefore not used when the user judges the noise level to be insufficient.

The "positive" random gaussian variables will first of all be defined:

A random variable X will be said to be positive when $Pr\{X<0\}<<1$.

Let $X_0$ be the normalized centered variable associated with X. Then:

$Pr\{X<0\}=Pr\{X_O<-m/\sigma\}$ in which $m=E[X]$ and $\sigma^2=E[(X-m)^2]$.

As soon as $m/\sigma$ is sufficiently large, X may be considered to be positive.

When X is gaussian, the distribution function of the normal law is designated by F(x) and:

$Pr\{X<0\}=F(-m/\sigma)$ for $X\epsilon N(m,\sigma^2)$

An immediate essential property is that the sum X of N independent positive gaussian variables $X_i\epsilon N(m_i;\ \sigma_i^2)$ remains a positive gaussian value:

$X=\Sigma_{1\leqq i\leqq N}X_i\epsilon N(\Sigma_{1\leqq i\leqq N}m_i;\ \Sigma_{1\leqq i\leqq N}\sigma_i^2)$ Fundamental results:

If $X=X_1/X_2$ where $X_1$ and $X_2$ are both independent gaussian random variables, such that $X_1\epsilon N(m_1;\ \sigma_1^2)$ and $X_2\epsilon N(m_2;\ \sigma_2^2)$, $m=m_1/m_2$, $\alpha_1=m_1/\sigma_1$, $\alpha_2=m_2/\sigma_2$ are set.

When $\alpha_1$ and $\alpha_2$ are sufficiently large to be able to assume that $X_1$ and $X_2$ are positive, the probability density $f_X(x)$ of $X=X=X_1/X_2$ may then be approximated by:

$$f_X(x)=(2\pi)^{-1/2}\alpha_1\alpha_2 m\frac{\alpha_1^2x+\alpha_2^2m}{(\alpha_1^2x^2+\alpha_2^2m^2)^{3/2}}\ e^{-\frac{\alpha_1^2\alpha_2^2(x-m)^2}{2(\alpha_1^2x^2+\alpha_2^2m^2)U(x)}}$$

in which U(x) is the characteristic function of $R^+$: U(x)=1 if $x\leqq 0$ and U(x)=0 if x<0 In the following, there is set:

$$f(x,y|\alpha,\beta)=(2\pi)^{-1/2}\alpha\beta\ y\frac{\alpha^2x+\beta^2y}{(\alpha^2x^2+\beta^2y^2)^{3/2}}\cdot e^{-\frac{\alpha^2\beta^2(x-y)^2}{2(\alpha^2x^2+\beta^2y^2)}}$$

such that: $f_X(x)=f(x,m|\alpha_1,\alpha_2).U(x)$

Let $$h(x,y|\alpha,\beta)=\alpha\beta\frac{x-y}{(\alpha^2x^2+\beta^2y^2)^{1/2}}$$

Setting $P(x,y|\alpha,\beta)=F[h(x,y|\alpha,\beta)]$.

Then: $Pr\{X<x\}=P(x,m|\alpha_1,\alpha_2)$ $f(x,y|\alpha,\beta)=\partial P(x,y|\alpha,\beta)/\partial x$ and $f(x,y|\alpha_1,\alpha_2)=\partial P(x,m|\alpha_1,\alpha_2)/\partial x$ Particular case: $\alpha=\beta$. Setting: $f\alpha(x,y)=f(x,y|\alpha,\beta)$, $h\alpha(x,y)=h(x,y\ \alpha,\beta)$ and $P\alpha(x,y)=P(x,y|\alpha,\beta)$ A few basic models of "positive" gaussian variables which can be used in the rest of the text will now be described. (1) Signal with deterministic energy: let there be samples x(0), . . . x(N−1) of any signal, the energy of which is deterministic and constant, or approximated by a deterministic or constant energy.

Then $U=\Sigma 0\leqq n\leqq N-1^{x(n)2\epsilon N(N\mu,0)}$ in which $\mu=(1/N)\Sigma_{0\leqq n\leqq N-1}x(n)^2$ Let us take as example the signal $x(n)=A\cos(n+\Theta)$ in which $\Theta$ is equally distributed between $[0,2\pi]$. For sufficiently large N, then: $(1/N)\ \Sigma_{0\leqq n\leqq N-1}x(n)^2\#E[x(n)^2]=A^2/2$. For sufficiently large N, U may be likened to $NA^2/2$ and thus to a constant energy.

(2) Gaussian White Process: Let there be a white and gaussian process x(n) such that $\sigma_x^2=E[x(n)^2]$.

For sufficiently large N, $U=\Sigma_{0\leqq n\leqq N-1}x(n)^2\epsilon N(N\sigma_x^2;2N\sigma_x^4)$ The parameter $\alpha$ is $\alpha=(N/2)^{1/2}$ (3) Narrow Band Gaussian Process: the noise x(n) comes from the sampling of the process x (t), itself coming from the filtering of a white gaussian noise b(t) by a bandpass filter h(t): x(t)=(h*b)(t), assuming that the transfer function of the filter h(t) is:

$H(f)=U_{[-f0-B/2,-f0+B/2]}(f)+U_{[f0-B/2,f0+B/2]}(f)$, in which U designates the characteristic function of the interval of the index and f0 the central frequency of the filter.

Thus $U\ \epsilon N(N\sigma_x^2,2\sigma_x^{4\Sigma}{}_{0\leqq i\leqq N-1,0\leqq j\leqq N-1}g_{f0,B,Te}(i-j)^2)$ with $g_{f0,B,Te}(k)=\cos(2\pi kf_0T_e)\sin_c(\pi kBT_e)$ The parameter $\alpha$is $\alpha=N/[2\Sigma_{0\leqq i\leqq N-1,0\leqq j\leqq N-1}g_{f0,B,Te}(i-j)^2]^{1/2}$ Sub-sampling of a gaussian process: This model is more practical than theoretical. If the correlation function is unknown, it is known, however that:

$\lim_{k\to+\infty}\Gamma_x(k)=0$.

Hence, for sufficiently large k such that $k>k_0$, the correlation function tends towards 0. Hence, instead of processing the series of samples x(0) . . . x(N−1), the sub-series $x(0)$, $x(k_0)$,$x(2k_0)$, . . . , may be processed, and the energy associated with this series remains a gaussian positive random variable, provided that there remain sufficient points in this sub-series to be able to apply the approximations due to the central limit theorem. Compatibility between energies.

Let $C_1=N(m_1,\sigma_1^2)$ and $C_2=N(m_2,\sigma_2^2)$

Setting: $m=m_1/m_2$, $\alpha_1=m_1/\alpha_1$ and $\alpha_2=m_2/\alpha_2$.

$\alpha_1$ and $\alpha_2$ are sufficiently large for the random variables of $C_1$ and $C_2$ to be able to be considered as positive random variables. Let there be (U,V) in which (U,V) belongs to $(C_1UC_2)\times(C_1UC_2)$. As before, U and V are assumed to be independent.

Setting $U\equiv V\leftrightarrow(U,V)\epsilon(C_1\times C_1)U(C_2UC_2)$. Let (u,v) be a value of the couple (U,V). If x=u/v, x is a value of the random variable X=U/V. Let there be s>1.

$1/s<x<s\leftrightarrow$ it is decided that $U\equiv V$ is true, which will be the decision $D=D_1$ $x<1/s$ or $x>s\leftrightarrow$ it will be decided that $U\equiv V$ is false, which will be the decision $D=D_2$. This decision rule is thus associated with 2 hypotheses:

$H_1\leftrightarrow U\equiv V$ is true, $H_2\leftrightarrow U\equiv V$ is false.

Setting I=[1/s,s].

The detection rule is then expressed as: $x\ \epsilon I\leftrightarrow D=D_1$, $x\ \epsilon R-I\leftrightarrow D=D_2$ It will be said that u and v are compatible when the decision $D=D_1$ is taken.

This decision rule allows a correct decision probability, the expression of which depends in fact on the value of the probabilities $Pr\{H_1\}$ and $Pr\{H_2\}$.

However, these probabilities are not in general known in practice.

An approach of the Neyman-Pearson type is then preferable in practice, since the decision rule is reduced to two hypotheses, seeking to provide a certain fixed value a priori for the false alarm probability which is:

$P_{fa}=Pr\{D_1|H_2\}=P(s,m|\alpha_1,\alpha_2)-P(1/s,m|\alpha_1,\alpha_2)$

The choice of the models of the signals and of the noises determines $\alpha_1$ and $\alpha_2$. We will then see that m appears as homogeneous with a signal-to-noise ratio which will be fixed heuristically. The threshold is then fixed so as to ensure a certain value of $P_{fa}$.

Particular case: $\alpha_1=\alpha_2=\alpha$. Then: $P_{fa}=P\alpha(s,m)-P\alpha(1/s,m)$ Compatibility of a set of values:

Let $\{u_1, \ldots, u_n\}$ be a set of values of positive gaussian random variables. It will be said that these values are compatible with each other if, and only if, the $u_i$ are compatible 2 by 2.

Models of the signal and of the noise used by the method of the invention.

In order to apply the procedures corresponding to the foregoing theoretic reminders, it is necessary to fix a model of the noise and of the signal. We will use the following example. This model is governed by the following hypotheses:

Hypothesis 1: We assume that we do not know the useful signal in its form, but we make the following hypothesis: $\forall$ the value s(0),. . . ,s(N−1) of s(n), the energy $S=(1/N)\,\Sigma_{0\leq n\leq N-1}s(n)^2$ is bounded by $\mu_s^2$, this as soon as N is sufficiently large, such that:

$S=\Sigma_{0\leq n\leq N-1}s(n)^2>N\mu_s^2$

Hypothesis 2: The useful signal is disturbed by an additive noise denoted x(n), which is assumed to be gaussian and in a narrow band. It is assumed that the process x(n) processed is obtained by narrow band filtering of a gaussian white noise.

The correlation function of such a process is then:

$\Gamma_x(k)=\Gamma_x(0)\cos(2\pi kf_0T_e)\mathrm{sinc}(\pi kBT_e)$.

If N samples x(n) of this noise are considered, and setting: $g_{f0,B,Te}(k)=\cos(2\pi kf_0T_e)\sin_c(\pi kBT_e)$, then: $V=(1/N)\Sigma_{0\leq n\leq N-1}x(n)^2\epsilon N(N\sigma_x^2,\ 2\sigma_x^4\Sigma_{0\leq i\leq N1,0\leq j\leq N-1}g_{f0,B,Te}(i-j)^2)$ The parameter $\alpha$ of this variable is $\alpha=N/[2\Sigma_{0\leq i\leq N-1,0\leq j\leq N-1}g_{f0,B,Te}(i-j)^2]^{1/2}$ Hypothesis 3: the signals s (n) and x(n) are then assumed to be independent. It is assumed that the independence between s(n) and x(n) implies decorrelation in the time-based sense of the term, that is to say that it is possible to write:

$$c=\frac{\Sigma_{0\leq n\leq N-1}s(n)x(n)}{(\Sigma_{0\leq n\leq N-1}s(n)^2)^{1/2}(\Sigma_{0\leq n\leq N-1}x(n)^2)^{1/2}}=0$$

This correlation coefficient is only the expression in the time domain of the spatial correlation coefficient defined by:

$E[s(n)x(n)]/E[s(n)^2]E[x(n)^2])^{1/2}$ when the processes are ergodic.

Let $u(n)=s(n)+x(n)$ be the total signal, and $U=\Sigma_{0\leq n\leq N-1}u(n)^2$.

U may then be approximated by:

$U=\Sigma_{0\leq n\leq N-1}s(n)^2+\Sigma_{0\leq n\leq N-1}x(n)^2$

Since: $\Sigma_{0\leq n\leq N-1}s(n)^2\geqq\mu_s^2$, then: $U\geqq N\mu_s^2+\Sigma_{0\leq n\leq N-1}x(n)^2$.

Hypothesis 4: As we are assuming that the signal exhibits a bounded mean energy, we are assuming that an algorithm capable of detecting an energy $\mu_s^2$ will be capable of detecting any signal of higher energy. Having regard to the preceding hypotheses, the class $C_1$ is defined as being the class of energies when the useful signal is present. According to hypothesis 3, $U\geqq N\mu_2^2+\Sigma_{0\leq n\leq N-1}x(n)^2$ and according to hypothesis 4, if the energy $N\mu_s^2+\Sigma_{0\leq n\leq N-1}x(n)^2$ is detected, it will also be known how to detect the total energy U. According to hypothesis 2, $N\mu_s^2+\Sigma_{0\leq n\leq N-1}x(n)^2\epsilon N(N\mu_s^2+N\sigma_x^2,\ 2\sigma_x^4\Sigma_{0\leq i\leq N-1,0\leq j\leq N-1}g_{f0,B,Te}(i-j)^2)$. Thus $C_1=N(N\mu_s^2+N\sigma_x^2,\ 2\sigma_x^4\Sigma_{0\leq i\leq N-1,0\leq j\leq N-1}g_{f0,B,Te}(i-j)^2)$ and the parameter $\alpha$ of this variable is equal to $\alpha_1=N(1+r)/[2\Sigma_{0\leq i\leq N-1,0\leq j\leq N-1}g_{f0,B,Te}(i-j)^2]^{1/2}$, in which $r=\mu_s^2/\sigma_x^2$ represents the signal-to-noise ratio. $C_2$ is the class of energies corresponding to the noise alone. According to hypothesis 2, if the noise samples are x(0), . . . ,x(M−1), then $V=(1/M)\Sigma_{0\leq n\leq M-1}x(n)^2\epsilon N(M\sigma_x^2,\ 2\sigma_x^4\Sigma_{0\leq i\leq M-1,0\leq j\leq M-1}g_{f0,B,Te}(i-j)^2)$.

The parameter a of this variable is:

$\alpha_2=M/[2\Sigma_{0\leq i\leq M-1,0\leq j\leq M-1}g_{f0,B,Te}(i-j)^2]^{1/2}$ Thus there is: $C_1=N(m_1,\ \sigma_1^2)$ and $C_2=N(m_2,\ \sigma_2^2)$, with: $m_1=N\mu_s^2+N\sigma_x^2$, $m_2=M\sigma_x^2$, $\sigma_1=\sigma_x^2[2\Sigma_{0\leq i\leq N-1,0\leq j\leq N-1}g_{f0,B,Te}(i-j)^2]^{1/2}$ and $\sigma_2=\sigma_x^2[2\Sigma_{0\leq i\leq M-1,0\leq j\leq M-1}g_{f0,B,Te}(i-j)^2]^{1/2}$.

Whence $m=m_1/m_2=(N/M)(1+r)$, $\alpha_1=m_1/\sigma_1=N(1+r)/[2\Sigma_{0\leq i\leq N-1,0\leq j\leq N-1}g_{f0,B,Te}(i-j)^2]1/2$ and $\alpha_2=m_2/\sigma_2=M/[2\Sigma_{0\leq i\leq M-1,0\leq j\leq M-1}g_{f0,B,Te}(i-j)^2]^{1/2}$ It will be noted that:

if the original noise is white and gaussian, the preceding hypotheses still remain valid. Suffice it to note that then $g_{f0,B,Te}(k)=\delta_0(k)$. The preceding formulae then become simplified:

$C_1=N(m_1,\sigma_1^2)$ and $C_2=N(m_2,\sigma_2^2)$, with: $m_1=N\mu_s^2+N\sigma_x^2$, $m_2=M\sigma_x^2$, $\sigma_1^2=2N\sigma_x^4$ and $\sigma_2=2M\sigma_x^4$.

Whence $m=m_1/m_2=(N/M)(1+r)$, $\alpha_1=m_1/\sigma_1=(1+r)(N/2)^{1/2}$ and $\alpha_2=m_2/\sigma_2=(M/2)^{1/2}$.

It is possible to tend towards such a model by sub-sampling the noise, and by taking, from the noise, only one sample in $k_0$ samples in which $k_0$ is such that: $\forall k>k_0$, $\Gamma_x(k)\rightarrow 0$.

the notion of compatibility between energies is set up only conditionally on knowing the parameter m a priori, and thus the signal-to-noise ratio r. The latter can be fixed heuristically on the basis of preliminary measurements of the signal-to-noise ratios exhibited by the signals which it is not wished to detect by the noise confirmation algorithm, or fixed peremptorily. The second solution is used in preference. In effect, the object of this processing aims to reveal, not all the noise frames, but only a few of them exhibiting a high probability of being constituted only by noise. There is therefore every interest in this algorithm being very selective. This selectivity is obtained by acting on the value of the false alarm probability which it is decided to provide and which will therefore be chosen to be very low (the maximum selectivity being established for $P_{FA}=0$, which leads to a zero threshold and to no noise detection, which is the extreme and absurd case). But this selectivity is also obtained by the choice of r: chosen too large, there is a risk of considering energies as representative of the noise, although these are energies from breathing, for example, exhibiting a signal-to-noise ratio lower than r. On the contrary, choosing r too small may limit the accessible $P_{FA}$, which will then be too high to be acceptable.

Having regard to the preceding models, and the calculation of the threshold having been done, the following detection and noise confirmation algorithm is applied, based essentially on the notion of compatibility, as described above.

The search for and the confirmation of noise frames is done among a number of frames $N_1$ defined by the user once and for all for his application (for example $N_1=40$), these frames being situated before the vocal kernel. The following hypothesis is made: the energy of the frames of noise alone is, on average, lower than that of the noise plus breathing and signal noise frames. The frame exhibiting the minimum energy among the $N_1$ frames is therefore assumed to consist only of noise. All the frames compatible with this frame, in the sense restated above, are then sought, by using the abovementioned models.

The noise detection algorithm will search, among a set of frames $T_1, \ldots, T_n$, for those which may be considered as noise.

Let $E(T_1), \ldots, E(T_n)$ be the energies of these frames, calculated in the form: $E(T_i)=\Sigma_{0\leqq n\leqq N-1}u(n)^2$ where u(n) are the N samples constituting the frame $T_i$.

The following hypothesis is made: the frame exhibiting the weakest energy is a noise frame. Let $T_{i0}$ be this frame.

The algorithm proceeds as follows:

| | | |
|---|---|---|
| | | The set of noise frames is initialized: |
| Noise | = | $\{T_{i0}\}$ |
| | | For $i$ describing $\{E(T_1), \ldots, E(T_n)\} - \{E(T_{i0})\}$ |
| | | Do |
| | | If $E(T_i)$ is compatible with each element of |
| Noise: | | |
| | | Noise = Noise $U$ $\{E(T_i)\}$ |
| | | End do |

Autoregressive Model of the noise.

Since the noise confirmation algorithm supplies a certain number of frames which may be considered as noise with a very strong probability, it is sought to construct, on the basis of the data from the time-based samples, an autoregressive model of the noise.

If x(n) designates the noise samples, x(n) is modeled in the form: $x(n)=\Sigma 1\leqq i\leqq p^{a_i x(n-i)+b(n)}$, in which p is the order of the model, the $a_i$'s is are the coefficients of the model to be determined and b(n) is the modeling noise, assumed to be white and gaussian if an approach by maximum likelihood is followed.

This type of modeling is widely discussed in the literature especially in "Spectrum Analysis—A Modern Perspective", by S. M. Kay and S. L. Marple Jr, which appeared in the Proceedings of the IEEE, Vol. 69, No. 11, November 1981.

As for the calculation algorithms of the model, numerous methods are available (Burg, Levinson-Durbin, Kalman, Fast Kalman, etc.).

The methods of the Kalman and Fast Kalman type will preferably be used, see articles "Adaptive Transverse Filtering" by O. Macchi/M. Bellanger which appeared in the magazine Signal Processing, Vol. 5, No. 3, 1988 and "Analysis of the signals and adaptive digital filtering" by M. BELLANGER which appeared in the CNET-ENST Collection, MASSON, which exhibit very good real-time performance. But this choice is not the only one possible. The order of the filter is chosen, for example, equal to 12, without this value being limiting.

Rejector filter

Let u(n)=s(n)+x(n) be the total signal, made up of the speech signal s(n) and of the noise s(n).

Let the filter $H(z)={}^1-\Sigma 1\leqq i\leqq p^{a_i z^{-i}}$.

Applied to the signal U(z), there is obtained H(z)U(z) =H(z)S(z)+H(z)X(z).

But: H(z)X(z)=B(z)=>H(z)U(z)=H(z)S(z)+B(z)

The rejective filter H(z) bleaches the signal, so that the signal at the output of this filter is a speech signal (filtered therefore deformed), with generally white and gaussian added noise.

The signal obtained is in fact unsuitable for recognition, since the rejector filter deforms the original speech signal.

However, the signal obtained being disturbed by a practically white and gaussian noise, it follows that this signal is very useful for carrying out detection of the signal s(n) according to the theory set out below, according to which the wideband signal obtained is kept, or it is filtered in advance in the fricative band, as described below (cf. "detection of fricatives").

It is for this reason that this rejector filtering is used after auto-regressive modeling of the noise.

Mean noise spectrum.

As a certain number of frames, confirmed as being noise frames, are available, it is then possible to calculate a mean spectrum of this noise, so as to build in spectral filtering, of the spectral subtraction or WIENER filtering type.

The WIENER filtering will be chosen, for example. Thus it is necessary to calculate which represents the mean noise spectrum. As the calculations are digital, there is access only to FFT's for digital signals weighted by a weighting window. Moreover, the spatial mean may only be approximated.

Let $X_1(n) \ldots, X_M(n)$ be the M+1 FFT's of the M noise frames confirmed as such, these FFT's being obtained by weighting of the initial time signal by a suitable apodization window.

$C_{XX}(f)=E[|X(f)|^2]$ is approximated by:

$\hat{C}_{XX}(n)=M_{XX}(n)=(1/M)\Sigma_{1\leqq i\leqq M+1}|X_i(n)|^2$

The performance of this estimator is given, for example, in the book "Digital signal processing" by L. Rabiner/C. M. Rader which appeared in IEEE Press.

As regards the Wiener filter, a few classical results are restated below, explained especially in the work "Speech Enhancement" by J. S. Lim which appeared in the Prentice-Hall Signal Processing Series publications.

Let u(t)=s(t)+x(t) be the total observed signal, in which s(t) designates the useful (speech) signal and x(t) the noise. In the frequency domain, there is obtained: U(f)=S(f) +X(f), with obvious notations.

The filter H(f) is then sought, such that the signal $\hat{S}(f)=H(f)U(f)$ is as close as possible to S(f) in the sense of the $L_2$ norm. H(f) is then sought minimizing: $E[|S(f)-\hat{S}(f)|^2]$.

It can then be shown that: $H(f)=1-(C_{XX}(f)/C_{UU}(f))$ in which $C_{XX}(f)=E[|X(f)|^2]$ and $C_{UU}(f)=E[|U(f)^2|]$.

This type of filter, because its expression is directly in terms of frequency, is particularly useful to apply when the parameterization is based on the calculation of the spectrum.

Implementation by smooth correlogram.

In practice, $C_{XX}$ and $C_{UU}$ are not accessible. They can only be estimated. A procedure for estimating $C_{XX}(f)$ has been described above.

$C_{UU}$ is the mean spectrum of the total signal u(n) which is available only over a single and unique frame. Moreover, this frame has to be parameterized in such a way as to able to play a part in the recognition process. There is therefore no way any averaging of the signal u(n) can be carried out, all the more so as the speech signal is a particularly non-stationary signal.

It is therefore necessary, from the u(n) data item, to construct an estimate of $C_{UU}(n)$. The smoothed correlogram is then used.

$C_{UU}(n)$ is then estimated by:

$\hat{C}_{UU}(k)=\Sigma_{0\leqq n\leqq N-1}F(k-n)|X(n)|^2$ in which F is a smoothing window constructed as follows, and N the number of points allowing calculation of the FFT's: N=256 points for example. A smoothing window is chosen in the time domain: $f(n)=a_0+a_1\cos(2\pi n/N)+a_2\cos(4\pi n/N)$. These windows are widely described in the abovementioned article: "On the Use of Windows for Hamming Analysis with the Discrete Fourier Transform" by F. J. Harris which appeared in Proceedings of the IEEE, Vol. 66, No. 1, January 1978. The function F(k) is then simply the Discrete Fourier Transform of f(n).

$\hat{C}_{UU}(k)=\Sigma_{0\leq n\leq N-1}F(k-n)|X(n)|^2$ appears as a discrete convolution between F(k) and $V(k)=|X(k)^2|$, such that $\hat{C}_{UU}=F*V$ Let $\hat{C}_{UU}$ be the $FFT^{-1}$ of $\hat{C}_{UU}$. $\hat{c}_{UU}(k)=f(k)v(k)$ where v(k) is the $FFT^{-1}$ of V(k).

$\hat{C}_{UU}(k)$ is then calculated according to the following so-called smoothed correlogram algorithm:

(1) Calculation of v(k) by inverse FFT of $V(n)=|X(n)|^2$ (2) Calculation of the product f.v (3) Direct FFT of the product f.v which leads to $\hat{C}_{UU}$ Rather than applying the same estimator for the noise and the total signal, the method of the invention applies the algorithm of the preceding smoothed correlogram to the mean noise spectrum $M_{XX}(n)$.

$\hat{C}_{XX}(k)$ is therefore obtained by:

$\hat{C}_{XX}(k)=\Sigma_{0\leq n\leq N-1}F(k-n)|M_{XX}(n)|^2$

The Wiener filter H(f) is therefore estimated by the series of values:

$\hat{H}(n)=1-(\hat{C}_{XX}(n)/\hat{C}_{UU}(n))$

The noise-free signal has the spectrum: $\hat{S}(n)=\hat{H}(n)U(n)$ A $FFT_{-1}$ may, possibly, make it possible to recover the noise-free time-based signal.

The noise-free spectrum $\hat{S}(n)$ obtained is the spectrum used for parameterization for the purpose of recognition of the frame.

In order to carry out detection of unvoiced signals, the procedures described above are also used, since energies representative of the noise are available (see above the algorithm for detection of the noise).

Activity detection

Let $C_1=N(m_1,\sigma_1^2)$ and $C_2=N(m_2,\sigma_2^2)$.

Since an algorithm is available, capable of bringing to light values of random variables belonging to the same class, of the class $C_2$ (for example), this with a very low probability of error, it becomes much easier to decide, by observation of the U/V couple, whether U belongs to the class $C_1$ or the class $C_2$. There are thus two distinct possible hypotheses, $H_1 \Leftrightarrow U\epsilon C_1$ and $H_2 \Leftrightarrow U\epsilon C_2$ corresponding to two distinct possible decisions:

$D=D_1 \Leftrightarrow$ decision $U\epsilon C_1$, denoted "$U\epsilon C_1$"

$D=D_2 \Leftrightarrow$ decision $U\epsilon C_2$, denoted "$U\epsilon C_2$"

Optimal decision

Setting: $m=m_1/m_2$, $\alpha_1=m_1/\alpha_1$ and $\alpha_2=m_2/\sigma_2$.

Let (U,V) be a pair of random variables, in which it is assumed that $V\epsilon C_2$ and $U\epsilon C_1 U C_2$. U and V are assumed to be independent. By observing the variable X=U/V, it is sought to take a decision between the two following possible decisions: "$C_1 \times C_2$", "$C_2 \times C_2$". Thus there are two hypotheses: $H_1 \Leftrightarrow U\epsilon C_1, H_2 \Leftrightarrow U\epsilon C_2$.

Let $p=Pr\{U\epsilon C_1\}$.

The decision rule is expressed in the following form:

$x>s \Leftrightarrow U\epsilon C_1, x<s \Leftrightarrow U\epsilon C_2$

The correct decision probability $P_c(s,m|\alpha_1,\alpha_2)$ is then:

$P_c(s,m|\alpha_1,\alpha_2)=p[1-P(s,m|\alpha_1,\alpha_2)]+(1-p)P(s,1|\alpha_2,\alpha_2)$ in which $p=Pr\{U\epsilon C_1\}$.

The optimum threshold is that for which $P_c(s,m|\alpha_1,\alpha_2)$ is maximum. The equation is therefore resolved:

$\partial P_c(s,m|\alpha_1,\alpha_2)/\partial s=0 \Leftrightarrow pf(s,m|\alpha_1,\alpha_2)-(1-p)f(s,1|\alpha_2,\alpha_2)=0$ Neyman-Pearson type approach In the preceding approach, it was assumed that the probability p was known. When this probability is unknown, it is possible to use a Neyman-Pearson type approach.

The probabilities of nondetection and of false alarm are defined:

$P_{nd}=\{x<s|H_1\}$ and $P_{fa}=\{x>s|H_2\}$ then: $P_{nd}=P(s,1|\alpha_2,\alpha_2)$ and $P_{fa}=1-P(s,m|\alpha_1,\alpha_2)$ $P_{fa}$ or $P_{nd}$ is then set, in order to determine the value of the threshold.

In order to apply the activity detection as described above in the case of speech, it is necessary to establish an energy-based model of the unvoiced signals which is compatible with the hypotheses which govern the correct operation of the methods described above. A model is therefore sought of the energies of the unvoiced fricatives /F/, /S/, /CH/, and of the unvoiced plosives /P/, /T/, /Q/, which make it possible to obtain energies of which the statistical law is approximately a gaussian one.

Model 1

The sounds /F/, /S/, /CH/ lie spectrally in a frequency band which stretches from about 4 kHz to more than 5 kHz. The sounds /P/, /T/, /Q/, as phenomena which are short in time, extend over a wider band. In the chosen band, it is assumed that the spectrum of these fricative sounds is relatively flat, so that the fricative signal in this band may be modeled by a narrow-band signal. This may be realistic in certain practical cases without having recourse to the bleaching described above. However, in the majority of cases, it is advisable to work with a bleached signal so as to provide a noise model with a suitable narrow band.

By accepting such a narrow-band noise model, the ratio of two energies which may be processed by the methods described above has therefore to be processed.

Let s(n) be the speech signal in the band examined and x(n) the noise in this same band. The signals s(n) and x(n) are assumed to be independent.

The class $C_1$ corresponds to the energy of the total signal u(n)=s(n)+x(n) observed over N points, the class $C_2$ corresponds to the energy V of the noise alone observed over M points.

The signals being gaussian and independent, u(n) is a signal which is itself gaussian, such that:

$U=\Sigma_{0\leq n\leq N-1}u(n)^2 \epsilon N(N\sigma_u^2, 2\sigma_u^4\Sigma_{0\leq i\leq N-1,\ 0\leq j\leq N-1}g_{j/0,B}(i-j)^2)$ Similarly:

$V=\Sigma_{0\leq n\leq M-1}y(n)^2 \epsilon N(M\sigma_x^2, 2\sigma_x^2\Sigma_{0\leq i\leq M-1,0\leq j\leq M-1}g_{j/0,B}(i-j)^2)$, in which y(n) designates, it will be remembered, another value of the noise x(n) over a time slice other than that in which u(n) is observed. The theoretical results above may therefore be applied with:

$C_1=N(N\sigma_u^2, 2\sigma_u^{4\Sigma}{}_{0\leq i\leq N-1,0\leq j\leq N-1}g_{j/0,B}(i-j)^2)$, $C_2=N(M\sigma_x^2, 2\sigma_x^{4\Sigma}{}_{0\leq i\leq M-1,0\leq j\leq M-1}g_{j/0,B}(i-j)^2)$ $m=(N/M)\sigma_u^2/\sigma_x^2$, $\alpha_1=N/(2\Sigma_{0\leq i\leq N-1,\ 0\leq j\leq N-1}g_{j/0,B}(i-j)^2)^{1/2})$, $\alpha_2=M/(2\Sigma_{0\leq i\leq M-1,0\leq j\leq M-1}g_{j/0,B}(i-j)^2)^{1/2})$ It will be noted that $m=(N/M)(1+r)$ in which $r=\sigma_s^2/\sigma_x^2$ finally designates the signal-to-noise ratio.

In order to arrive at the complete resolution of this problem, it is necessary to be able to know the signal-to-noise ratio r as well as the probability p of presence of the useful signal. What appears here to be a limitation is common to the other two models dealt with below.

Model 2

As in the case of model 1, it is sought to detect solely the unvoiced fricatives, thus to detect a signal in a particular band.

Here, the model of the fricative signal is not the same as before. It is assumed that the fricatives exhibit the minimum energy $\mu_s^2=\Sigma_{0\leq n\leq N-1}s(n)^2$ which is known, by virtue, for example, of a learning process, or which is estimated.

The voiced sound is independent of the noise x(n) which here is narrow band gaussian.

If y(n), for n lying between 0 and M−1, designates another value of the noise x(n) over a time slice distinct from that in which the total signal u(n)=s(n)+x(n) is observed, then:

$V=\Sigma_{0\leq n\leq M-1}y(n)^2\epsilon N(M\sigma_x^2,2Tr(C_x,M^2))$ in which $C_{x,M}$ designates the correlation matrix of the M-uplet: $^t(y(0), \ldots ,y(M-1))$ As far as the energy $U=\Sigma_{0\leq n\leq N-1}u(n)^2$ of the total signal is concerned, this may be written as:

$U=\mu_s^2+\Sigma_{0\leq n\leq N-1}x(n)^2$

This result is obtained by assuming that the independence between s(n) and x(n) is expressed by the decorrelation in the time-based sense of the term, that is to say that it is possible to write:

$$c=\frac{\Sigma_{0\leq n\leq N-1}s(n)x(n)}{(\Sigma_{0\leq n\leq N-1}s(n)^2)^{1/2}(\Sigma_{0\leq n\leq N-1}x(n)^2)^{1/2}}=0$$

As $V'=\Sigma_{0\leq n\leq N-1}x(n)^2\epsilon N(N\sigma_x^2,\ 2Tr(C_x,N^2))$ in which $C_{x,N}$ designates the correlation matrix of the N-uplet: $^t(x(0), \ldots ,x(N-1))$, then:

$U=\mu_s^2+\Sigma_{0\leq n\leq N-1}x(n)^2\epsilon N(N\mu_s^2+N\sigma_x^2,\ 2Tr(C_x,\ N^2))$ It is thus possible to apply the theoretical results above with:

$C_1=N(N\mu_s^2+N\sigma_x^2,\ 2Tr(C_{x,N}^2))$, $C_2=N(M\sigma_x^2,\ 2Tr(C_{x,M}^2))$ $m=(N/M)(1+\mu_s^2/\sigma_x^2)$, $\alpha_1=N(\mu_s^2+\sigma_x^2)/(2Tr(C_{x,N}^2))^{1/2}$, $\alpha_2=M\sigma_x^2/(2Tr(C_{x,M}^2))^{1/2}$, It will be noted that $m=(N/M)(1+r)$ where $r=\mu_s^2/\sigma_x^2$ finally designates the signal-to-noise ratio. The same remark as that of model 1, relating to the signal-to-noise ratio r and the probability p of presence of the useful signal, is valid here.

Model 3.

In this model, it is sought to carry out a detection of all the unvoiced signals, with a white gaussian noise hypothesis.

The narrow band signal model used previously is therefore no longer valid. It is possible only to assume to be dealing with a wide-band signal of which the minimal energy $\mu_s^2$ is known.

Thus:

$C_1=N(N\mu_s^2+N\sigma_x^2,2N\sigma_x4)$, $C_2=N(M\sigma_x^2,2M\sigma_x4)$ $m=(N/M)(1+r)$, with $r=\mu_s^2/\sigma_x^2$ $\alpha_1=(1+r)(N/2)^{1/2}$, $\alpha_2=(M/2)^{1/2}$, In order to use this model, the noise must be white and gaussian. If the original noise is not white, it is possible to approximate this model by, in fact, sub-sampling the observed signal, that is to say by considering only one sample in 2, 3 or even more, according to the autocorrelation function of the noise, and by assuming that the speech signal thus sub-sampled still exhibits detectable energy. But it is also possible, and this is preferable, to use this algorithm on a signal which is bleached by a rejector filter, since then the residual noise is approximately white and gaussian.

The preceding remarks relating to the value, a priori, of the signal-to-noise ratio and the probability of presence of the useful signal, remain still and always valid. Algorithms for the detection of unvoiced sounds.

By using the preceding models, two algorithms for the detection of unvoiced sounds are set out below.

Algorithm 1:

Having available energies representative of the noise, it is possible to average these energies so that a "reference" noise energy is obtained. Let $E_0$ be this energy. For $N_3$ frames $T_1, \ldots, T_n$ which precede the first voiced frame, the following process is followed:

Let $E(T_1), \ldots, E(T_n)$, be the energies of these frames, calculated in the form $E(T_i)=\Sigma_{0\leq n\leq N-1}u(n)^2$ where u(n) are the N samples constituting the frame $T_i$.

For $E(T_i)$ describing $\{E(T_1), \ldots, E(T_n)\}$

Do

If $E(T_i)$ is compatible with $E_0$ (decision on the value of $E(T_i)/E_0$).

Detection on the frame $T_i$,

End do.

Algorithm 2:

This algorithm is a variant of the preceding one. For $E_0$ are used either the mean energy of the frames detected as the noise, or the value of the lowest energy of all the frames detected as being the noise.

Then the process is as follows:

For $E(T_i)$ describing $\{E(T_1), \ldots, E(T_n)\}$.

Do

If $E(T_i)$ is compatible with $E_0$ (decision on the value of $E(T_i)/E_0$).

Detection on the frame $T_i$.

Else $E_0=E(T_i)$.

End do

The signal-to-noise ratio r may be estimated or fixed heuristically, provided that a few prior experimental measurements, characteristic of the field of application, are carried out, in such a way as to fix an order of magnitude of the signal-to-noise ratio which the fricatives exhibit in the chosen band.

The probability p of presence of unvoiced speech is itself also a heuristic data item, which modulates the selectivity of the algorithm, on the same basis moreover as the signal-to-noise ratio. This data item may be estimated according to the vocabulary used and the number of frames over which the search for unvoiced sounds is done. Simplification in the case of a slightly noisy medium.

In the case of a slightly noisy medium, for which no noise model has been determined, by virtue of the simplifications proposed above, the theory restated previously justifies the use of a threshold, which is not related bijectively to the signal-to-noise ratio, but which will be fixed totally empirically.

A useful alternative for media where the noise is negligible is to be satisfied with the detection of voicing, to eliminate the detection of unvoiced sounds, and to fix the start of speech at a few frames before the vocal kernel (about 15 frames) and the end of speech at a few frames after the end of the vocal kernel (about 15 frames).

I claim:

1. A method of detecting speech in noisy signals, comprising the steps of:

sampling plural speech frames including plural noise frames, at least one voiced frame and additional plural noise frames after said at least one voiced frame;

identifying said at least one voiced frame;

identifying said plural noise frames preceding said at least one voiced frame;

constructing an autoregressive model of noise and a mean noise spectrum based on said plural noise frames preceding said at least one voiced frame;

bleaching said plural noise frames preceding said at least one voiced frame by using a rejector filter;

removing noise by spectral noise removal from said plural noise frames preceding said at least one voiced frame;

finding an actual start of speech in the bleached plural noise frames;

extracting acoustic vectors used by a voice recognition system from the plural noise-removed frames lying between the actual start of speech and a first of said at least one voiced frame;

removing noise from and parameterizing said at least one voiced frame;

finding an actual end of speech; and removing noise and parameterizing frames lying between a last of said at least one voiced frame and the actual end of speech.

2. The method as claimed in claim 1, wherein the step of bleaching comprises:

using a rejector filter constructed in said constructing step.

3. The method as claimed in claim 2, further comprising the steps of:

reinitializing processing parameters after the last of said at least one voiced frame has been parameterized.

4. The method as claimed in claim 1, wherein the step of sampling comprises:

sampling frames of signals to be processed; and processing the detected frames by Fourier transforms, wherein, when two Fourier transforms are consecutive in time, the two Fourier transforms are calculated over three consecutive frames with an overlap of one frame.

5. The method as claimed in claim 1, wherein the step of identifying said at least one voiced frame comprises:

calculating a pitch for each of the sampled plural speech frames; and determining, for each of the sampled plural speech frames, if a voicing is present in a frame based on the calculated value of a pitch corresponding to said each frame.

6. The method as claimed in claim 5, wherein the step of identifying said at least one voiced frame comprises:

identifying said at least one voiced frame after having determined that at least three voiced frames are in series without a hole bigger than a maximum hole size.

7. The method as claimed in claim 5, wherein the step of calculating the pitch of one of said sampled plural speech frames comprises:

calculating a correlation of a signal of said one frame with a delayed form of the signal of said one frame.

8. The method as claimed in claim 1, further comprising the step of:

detecting unvoiced sounds by thresholding.

9. The method as claimed in claim 1, further comprising the step of: detecting unvoiced speech based on a distance between a vocal kernel and a fricative block, and a size of said fricative block.

10. The method as claimed in claim 1, wherein the steps of removing noise from said plural noise frames preceding said at least one voiced frame comprises:

obtaining a mean noise spectrum of the plural noise frames preceding said at least one voiced frame by Wiener filtering; and removing noise based on the obtained mean noise spectrum.

11. The method as claimed in claim 10, further comprising the step of:

applying a smooth correlogram to the mean noise spectrum.

* * * * *